United States Patent [19]

Wolfes

[11] 4,360,437

[45] Nov. 23, 1982

[54] CONCENTRATED TEXTILE TREATMENT COMPOSITIONS AND METHOD FOR PREPARING THEM

[75] Inventor: Wilhelm H. O. Wolfes, Brussels, Belgium

[73] Assignee: The Proctor & Gamble Company, Cincinnati, Ohio

[21] Appl. No.: 222,418

[22] Filed: Jan. 5, 1981

[30] Foreign Application Priority Data

Jan. 11, 1980 [GB] United Kingdom ..... 8001002
Oct. 14, 1980 [GB] United Kingdom ..... 8033043

[51] Int. Cl.[3] ..... D06M 13/36; D06M 13/46
[52] U.S. Cl. ..... 252/8.8; 252/8.6
[58] Field of Search ..... 252/8.8, 547

[56] References Cited

U.S. PATENT DOCUMENTS 3,247,018 4/1966 Hagge et al. ..... 252/8.8 X
3,681,241 8/1972 Rudy ..... 252/8.75
4,082,678 4/1978 Pracht et al. ..... 252/8.6
4,149,978 4/1979 Goffinet ..... 252/8.8
4,268,402 5/1981 Kurze et al. ..... 252/8.8

FOREIGN PATENT DOCUMENTS 2722079 12/1978 Fed. Rep. of Germany .

OTHER PUBLICATIONS

Schwartz, A. M. and Perry, J. W., Surface Active Agents (1978), pp. 172–177.

*Primary Examiner*—P. E. Willis, Jr.

[57] ABSTRACT

Concentrated fabric softening/static control compositions, for use in the rinse cycle of the laundering operation, are disclosed. These compositions include a water-insoluble cationic softener, a long-chain hydrocarbon, such as paraffin, and specific mono-long chain amine or amine-derived compounds. The use of these amine compounds provides compositions, exhibiting excellent softening and static control performance, which are stable during long periods of storage and which are easily processed due to their viscosity characteristics. A method for preparing these compositions is also disclosed.

6 Claims, No Drawings

CONCENTRATED TEXTILE TREATMENT COMPOSITIONS AND METHOD FOR PREPARING THEM

BACKGROUND OF THE INVENTION

The present invention relates to concentrated textile treatment compositions and a method for preparing such compositions. In particular, it relates to fabric softener/static control compositions for use in the laundering process, which possess excellent storage stability and viscosity/processing characteristics.

Compositions used in the laundry solution to provide fabric softening and static control benefits to laundered fabrics, which utilize water-insoluble cationic compounds, such as ditallow dimethylammonium materials, are well-known. See, for example, U.S. Pat. No. 3,958,059, Diehl, issued May 18, 1976; and U.S. Pat. No. 3,920,563, Wixon, issued Nov. 18, 1975. Only recently has it been shown that improved softening and static control performance can be achieved using mixtures of such water-insoluble cationic materials together with long-chain hydrocarbons, such as paraffin. See Belgian Pat. No. 868,934, published Jan. 12, 1979. In addition to excellent fabric softening and static control performance, one of the major advantages of such compositions is that, by the proper selection and combination of components, they can be produced in concentrated form utilizing relatively high active levels. While such concentrated compositions provide numerous convenience benefits to both the manufacturer and the consumer, the use of such high levels of cationic and paraffin materials (frequently as high as 20 to 40% of the total composition) can lead to undesirably high viscosities and, therefore, difficulties in processing, as well as products which can form separate phases during long periods of storage.

The present invention is based on the discovery that the addition of specific mono-long chain amine or amine-derived compounds to aqueous textile treating compositions, containing water-insoluble cationic softeners and long-chain hydrocarbons, results in compositions which exhibit excellent storage stability and viscosity properties, as well as outstanding fabric softening and static control performance. The compositions also exhibit improved filming properties, thereby reducing undesirable dispenser residues.

Amines of the type used herein are well-known. See Schwartz and Perry, *Surface-Active Agents,* Robert E. Kreiger Publishing Company, Huntington, New York, 1978, pages 172–177. These compounds are generally used as emulsifiers, such as in the preparation of cosmetic formulations. The mono-long chain amidoamines have also been taught for use as liquifiers in fabric softener compositions containing non-cationic softener components. See German Specification No. 27 22 079, published Dec. 14, 1978 and German Specification No. 28 41 076. However, they have not been taught or suggested for use in softener compositions which utilize the specific water-insoluble cationic/long-chain hydrocarbon mixtures required in the present invention.

Certain water-soluble cationic materials, such as ethoxylated diamine salts (see Belgian Pat. No. 868,934, published Jan. 12, 1979) and mono-long chain quaternary ammonium salts (see British Patent Application No. 79-13934, filed Apr. 21, 1979) have been taught in combination with cationic/hydrocarbon softener mixtures, such as those used in the present invention; however, as demonstrated herein, the specific amines used in the present invention, particularly the amidoamines, demonstrate advantages over these water-soluble cationic materials.

Accordingly, it is an object of the present invention to provide aqueous textile treating compositions which exhibit excellent viscosity and storage stability properties.

It is a further object of the present invention to provide aqueous textile treating compositions which exhibit excellent fabric softening and static control performance when used in rinse cycle of an automatic laundering operation.

It is a still further object of the present invention to provide a method for preparing storage stable aqueous textile treating compositions which contain a water-insoluble cationic material and a long-chain hydrocarbon, such as paraffin.

DESCRIPTION OF THE INVENTION

In summary, the present invention provides aqueous textile treatment compositions which comprise:

(a) from about 4% to about 25% of a water-insoluble cationic fabric softener;

(b) from about 0.25% to about 25% of a $C_{12}$–$C_{40}$ hydrocarbon; and (c) from about 0.05% to about 5% of an amine or amine-derived compound having the formula:

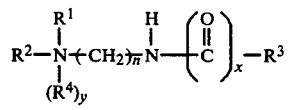

wherein each $R^1$ is selected from the group consisting of hydrogen and $C_1$–$C_4$ alkyl, each $R^2$ is selected from the group consisting of $C_1$–$C_4$ alkyl and

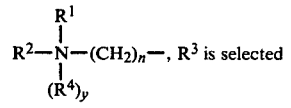

, $R^3$ is selected from the group consisting of $C_8$–$C_{28}$ alkyl and alkenyl groups, each $R^4$ is selected from the group consisting of hydrogen and $C_1$–$C_4$ alkyl, each y is 0 or 1, x is 0 or 1 and each n is from 1 to 6;

wherein the ratio of (a):(b) is from about 20:1 to about 1:5.

These compositions are preferably prepared by forming a premixture of components (a) and (b), above, and then adding this premixture, with agitation, to a water solution of component (c).

The essential components of the present invention will now be described in more detail. In this specification, all stated percentages and ratios are by weight, unless otherwise stated.

The water-insoluble cationic fabric softeners used herein can be any fabric substantive cationic compound the acid salt form of which has a solubility in water, at pH equal 2.5 and 20° C., of less than about 10 g./1. Highly preferred materials are quaternary ammonium salts having two $C_{10}$–$C_{22}$ alkyl chains; these long-chains may optionally be substituted or interrupted by functional groups, such as —OH, —O—, —CONH—, —COO—.

Well-known species of substantially water-insoluble quaternary ammonium compounds have the formula

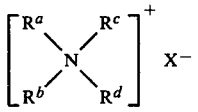

wherein $R^a$ and $R^b$ represent hydrocarbyl groups of from about 10 to about 24 carbon atoms, $R^c$ and $R^d$ represent hydrocarbyl groups containing from 1 to about 4 carbon atoms, and X is an anion, preferably selected from halide, and methyl sulfate radicals. Representative examples of these cationic softener materials include ditallow dimethylammonium chloride, ditallow dimethylammonium methyl sulfate, dihexadecyl dimethylammonium chloride, di (hydrogenated tallow) dimethylammonium chloride, dioctadecyl dimethylammonium chloride, dieicosyl dimethylammonium chloride, didocosyl dimethylammonium chloride, di (hydrogenated tallow) dimethylammonium methyl sulfate, dihexadecyl diethyl ammonium chloride, and di (coconutalkyl) dimethylammonium chloride. Di-$C_{16}$–$C_{22}$ quaternary ammonium materials, especially di-tallow dimethylammonium chloride, are preferred cationic materials for use herein; when such materials are used, it is preferred that the hydrocarbon material used be a $C_{18}$–$C_{24}$ paraffin.

Another class of suitable water-insoluble cationic materials are the alkylimidazolinium salts having the formula

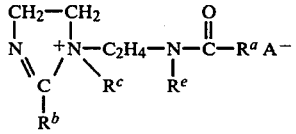

wherein $R^c$ is an alkyl containing from 1 to 4, preferably 1 or 2, carbon atoms; $R^a$ is an alkyl containing from 9 to 25 carbon atoms; $R^b$ is an alkyl containing from 8 to 25 carbon atoms; $R^e$ is hydrogen or an alkyl containing from 1 to 4 carbon atoms; and A is an anion, preferably a halide or methyl sulfate radical. Preferred imidazolinium salts include 1-methyl-1,1- (tallowylamido)ethyl -2-tallowyl-4,5-dihydroimidazolinium methyl sulfate (commercially available under the trade name VARISOFT 475, from SHEREX Company, Columbus, Ohio) and 1-methyl-1- (palmitoylamido)ethyl -2-octadecyl-4,5-dihydroimidazolinium chloride. The material sold by REWO under the trade name STEINAQUAT is also a preferred material for use herein. Depending upon the reaction, possibly the quaternization, conditions, the alkylimidazolinium salts can contain minor (e.g. less than 50%) levels of reaction by-products which are less water-insoluble than the quaternized species. Also suitable for use herein are the imidazolinium fabric softening components disclosed in U.S. Pat. No. 4,127,489, Pracht and Nirschl, issued Nov. 28, 1978, incorporated herein by reference. When the above-described imidazolinium materials are utilized in the compositions of the present invention, it is preferred that the hydrocarbon component used be a $C_{14}$–$C_{17}$ paraffin.

The cationic materials, described above, are utilized in the present invention in an amount of from about 4% to about 25%, preferably from about 6% to about 20%, and most preferably from about 8% to about 16%, of the final textile treating composition.

The second essential component of the compositions of the present invention is a hydrocarbon material having from about 12 to about 40 carbon atoms. This material is included in an amount of from about 0.25% to about 25%, preferably from about 5% to about 20%, of the final composition. The precise amount of hydrocarbon material used is based largely on the type and the amount of water-insoluble cationic material selected and may be adjusted in order to give optimum fabric softening and static control performance; thus a composition which includes 12% of a di-tallowyl imidazolinium material, such as Steinaquat, may require 10% to 18% of $C_{14}$–$C_{17}$ paraffin, while a composition containing 13% of ditallow dimethylammonium chloride may require 6% to 12% of $C_{18}$–$C_{20}$ paraffin. Preferred hydrocarbon materials have from about 12 to 24 carbon atoms, with especially preferred materials being selected from those containing from about 14 to 22 carbon atoms.

Normally, suitable hydrocarbons are found in the paraffin and olefin series, but other materials, such as alkynes and cyclic hydrocarbons, are not excluded. Materials known generally as paraffin oil, soft paraffin wax, and petrolatum are suitable. Examples of specific materials useful herein are hexadecane, octadecane, eicosane, and octadecene. Preferred commercially-available paraffin mixtures include spindle oil, light oil, and technical grade mixtures of $C_{14}$–$C_{17}$ n-paraffins and $C_{18}$–$C_{20}$ n-paraffins.

The ratio of cationic softener material to hydrocarbon, used in the present invention, is from about 20:1 to about 1:5, preferably from about 10:1 to about 1:4, more preferably from about 5:1 to about 1:3, particularly 3:1 to 1:2.

In addition to the above-discussed cationic and hydrocarbon components, the compositions of the present invention also include a mono-long chain amine or amine-derived compound. These compounds are present in an amount of from 0.05% to about 5%, preferably from about 0.25 to about 2.5%, and most preferably from about 0.15% to about 0.6% of the finished composition. The weight ratio of water-insoluble cationic softener to amine component is usually in the range from about 200:1 to 5:1 and preferably from about 50:1 to about 5:1. In another preferred aspect of this invention, the ratio (cat. soft:amine) is in the range from 80:1 to 60:1. The amine or amine-derived compounds useful in the compositions of the present invention have the formula

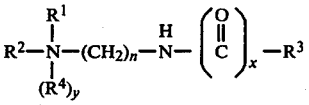

wherein each $R^1$ is hydrogen or a $C_1$–$C_4$ alkyl, preferably a $C_1$–$C_4$ alkyl, and most preferably methyl or ethyl; each $R^2$ is a $C_1$–$C_4$ alkyl or

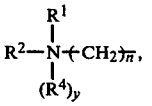

preferably a $C_1$–$C_4$ alkyl, most preferably methyl or ethyl; $R^3$ is a $C_8$–$C_{28}$ alkyl or alkenyl group, preferably $C_{12}$–$C_{18}$ alkyl; each $R^4$ is hydrogen or $C_1$–$C_4$ alkyl ($R^4$ may also be substituted or interrupted by functional groups, such as —OH, —O—, —CONH—, —COO—), preferably hydrogen or methyl; each y may be 0 to 1, preferably 1; x may be 0 or 1, preferably 1; and each n is from 1 to 6, preferably from 2 to 4. Particularly preferred compounds have the formula

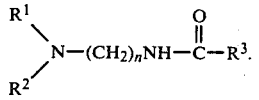

In this formula $R^1$ and $R^2$ are as defined above, and are preferably methyl or ethyl groups, n is 2 or 3, and $R^3$ is a $C_{12}$–$C_{18}$ alkyl group, especially coconut alkyl, lauryl, myristyl, palmityl, mixted stearyl-palmityl, tallow, stearyl, or isostearyl.

The amine or amine-derived compounds useful in the present invention include amines, polyamines, quaternary ammonium compounds, polyquaternary ammonium compounds, and protonated amines. Polyamine or polyquaternary compounds useful in the present invention generally do not contain more than eight nitrogen atoms. In preferred compositions, amines are used in their protonated form by combining them with an organic or inorganic acid, in an amine:acid equivalent ratio of at least about 1:1, prior to their combination with the remaining composition components.

Although the compositions of the present invention may be made in any manner conventionally known in the fabric softener art, it has been found that a specific preferred method of preparation results in the best viscosity and stability properties. In this preferred process, a premixture of the water-insoluble cationic softener and long-chain hydrocarbon components is formed. This premixture is then added, with agitation and, preferably, heat, to a water solution of the amine or amine-derived compound. The water solution may also contain other components to be included in the compositions of the present invention.

In addition to the above-mentioned components, the compositions of the present invention may contain other ingredients conventionally used in softening and textile treating compositions. Thus, the compositions may comprise additional viscosity control agents, such as electrolytes (for example, calcium chloride), at levels of from about 100 to 1,000 ppm. It has been found that the use of the amine or amine-derived compounds disclosed herein permits the formulation of compositions having excellent viscosity characteristics while requiring lower levels of such electrolytes than would otherwise be necessary.

The compositions of the present invention may also contain additional textile treatment or conditioning agents. Such agents include silicones, as for example described in German Patent Application DOS No. 26 31 419, incorporated herein by reference. In general, such silicone components would be used in amounts of from about 0.1% to about 6%, preferably from 0.5% to 2%, of the softener composition.

The compositions can also contain water-soluble cationic surfactants, i.e., cationic surfactants having a solubility in water (pH 2.5 and 20° C.) of greater than 10 g./1. Such materials include ammonium salts having one $C_{12}$–$C_{24}$ alkyl chain, optionally substituted or interrupted by functional groups, such as —OH, —O—, —CONH—, —COO—. Highly preferred water-soluble cationic materials are the polyamine materials represented by the general formula

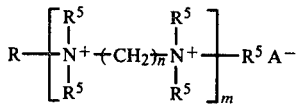

wherein R is selected from alkyl or alkenyl groups having from 10 to 24, preferably from 16 to 20, carbon atoms in the alkyl or alkenyl chain, and $RO(CH_2)_n$—; each $R^5$ is selected from hydrogen, $-(C_2H_4O)_pH$, $-(C_3H_6O)_pH$, $-(C_2H_4O)_r(C_3H_6O)_sH$, a $C_1$–$C_3$ alkyl group, $-(CH_2)_nN(R')_2$, wherein R′ is selected from hydrogen, $-(C_2H_4O)_pH$, $-(C_3H_6O)_pH$, $-(C_2H_4O)_p(C_3H_6O)_qH$ and $C_1$–$C_3$ alkyl; n is an integer from 2 to 6, preferably 2 or 3; m is an integer from 1 to 5, preferably 1 or 2; p, q, r and s are each numbers such that the total p+q+r+s in the molecule does not exceed 25 (preferably each p and q is 1 or 2 and each r and s is 1); and A represents one or more anions having total charge balancing that of the nitrogen atoms. Preferred water-soluble cationic materials are alkoxylated and contain not more than one ethoxy or propoxy group attached to each nitrogen atom, except that up to two of these groups can be attached to a terminal nitrogen atom which is not substituted with an alkyl group having from 10 to 24 carbon atoms.

The compositions of the present invention can also include the nonionic fabric softeners disclosed in German Patent Specification DOS No. 26 31 114, incorporated herein by reference. Highly preferred nonionic softeners are glycerol monostearate and sorbitan monostearate.

The compositions herein can contain other optional ingredients which are known to be suitable for use in textile softeners at usual levels for their known functions. Such adjuvants include emulsifiers, perfumes, preservatives, germicides, colorants, dyes, fungicides, stabilizers, brighteners and opacifiers.

When compositions of the present invention are used, they are added to the rinse liquor at a concentration of from about 10 ppm to about 1,000 ppm, preferably from about 50 ppm to about 500 ppm, of total active ingredient.

The following non-limiting examples illustrate the compositions and the method of preparing encompassed by the present invention. As used below, Steinaquat refers to a cationic material, commercially available from REWO, comprising mainly a di-tallowyl imidazolinium compound; SPAED refers to a $C_{16}$–$C_{18}$ amido ethyl diethylamine.

EXAMPLE I

Compositions of the present invention, containing 18% $C_{14}$–$C_{17}$ paraffin, 12% Steinaquat, 0.5% SPAED, 0.167% phosphoric acid (85% active) and about 500 ppm calcium chloride, were made using three different procedures. Composition A was made by mixing 180 g. of $C_{14}$–$C_{17}$ paraffin together with 150 g. of Steinaquat (80% active) at 65° C. (premixture). A water solution containing 653.33 g. of water, 5 g. of SPAED, 1.67 g. of phosphoric acid (85% active), and 3 g. of blue dye (1% active) was also made at 65° C. The premixture was then poured into the water solution, maintaining the temperature at about 65° C., and 2 g. of a calcium chloride solution (25% active) was added. The total mixture was then stirred for 5 minutes and the viscosity at 65° C. was measured; 5 g. of perfume was then added. Finally, the composition was cooled to 25° C. and the viscosity was measured. All viscosity measurements were made using a Brookfield Synchro-Lectric Viscometer, model LVF, and are expressed in centipoise. Composition B was made by adding the SPAED and phosphoric acid components directly into the cationic/paraffin premixture, rather than forming them into a separate water solution. Composition C was made by adding the SPAED component directly into the premixture, while forming a water solution of the phosphoric acid, and then proceeding as in composition A. The viscosity measurements for these compositions are summarized in the table, below. Viscosity measurements between about 100 to 700 centipoise over the temperature range measured are preferred for proper processing of the compositions.

| COMPOSITION | VISCOSITY (centipoise) 65° C. | 25° C. |
|---|---|---|
| A | 540 | 600 |
| B | >2,000 | >2,000 |
| C | 2,000 | 475 |

These data indicate the improved results obtained when the preferred manufacturing process, described herein, is utilized in making the compositions of the present invention.

Substantially similar results are obtained where the water-insoluble cationic softener utilized in the above example is replaced, in whole or in part, by ditallow dimethyl ammonium chloride, ditallow dimethylammonium methyl sulfate, dihexadecyl dimethylammonium chloride, di (hydrogenated tallow) dimethylammonium chloride, dioctadecyl dimethylammonium chloride, dieicosyl dimethylammonium chloride, didocosyl dimethylammonium chloride, di (hydrogenated tallow) dimethylammonium methyl sulfate, dihexadecyl diethyl ammonium chloride, di (coconutalkyl) dimethylammonium chloride, or mixtures of these compounds.

Similar results are also obtained where the long-chain hydrocarbon component, used above, is replaced, in whole or in part, by $C_{18}$–$C_{20}$ paraffin, $C_{20}$–$C_{22}$ paraffin, $C_{16}$–$C_{18}$ paraffin, hexadecane, octadecane, octadecene, eicosane or mixtures of these components.

Substantially similar results are also obtained where the SPAED component, used above, is replaced, in whole or in part, by stearyl-palmityl amidopropyl diethylamine, tallowyl amidopropyl dimethylamine, isostearyl amidopropyl dimethyl amine, stearyl-palmityl amidopropyl dimethylamine, stearyl-palmityl amidoethyl dimethylamine, lauryl amidopropyl dimethylamine, coconut amidopropyl dimethylamine, coconut amidoethyl dimethylamine, myristyl amidopropyl dimethylamine, palmityl amidopropyl dimethylamine, stearyl amidopropyl dimethylamine, a quaternized version of any of the above components, or mixtures of these components.

EXAMPLE II

The viscosities of compositions of the present invention were compared with viscosities of prior art compositions, as described below. Compositions using an 18% $C_{14}$–$C_{17}$ paraffin/12% Steinaquat active system, but containing different viscosity control agents used at different levels, were formulated in the manner described for composition A in Example I. The components of these compositions are given in the table, below. The only difference in processing among these compositions is that in composition G the viscosity control component, tallow trimethylammonium chloride, was added to the cationic/paraffin premixture, rather than being formed into a water solution.

| COMPONENTS | WEIGHT % COMPOSITIONS D | E | F | G | H | I |
|---|---|---|---|---|---|---|
| $C_{14}$–$C_{17}$ paraffin | 18 | 18 | 18 | 18 | 18 | 18 |
| Steinaquat | 12 | 12 | 12 | 12 | 12 | 12 |
| SPAED | 0.5 | — | — | — | — | — |
| Tallow trimethylammonium chloride | — | — | 1 | 1 | — | — |
| N—tallowyl—N, N',N'—tris (2-hydroxyethyl)-1,3-propane diamine | — | — | — | — | 0.75 | 0.25 |
| Phosphoric Acid | 0.167 | — | — | — | 0.326 | 0.11 |
| Calcium Chloride (ppm) | 550 | 700 | 650 | 650 | 650 | 650 |
| Water and Minors | BALANCE TO 100 | | | | | |

The viscosities of these compositions were measured according to the method described in Example I and the data are summarized in the table, below.

| COMPOSITION | VISCOSITY (centipoise) 65° C. | 25° C. |
|---|---|---|
| D | 255 | 250 |
| E | >2,000 | 235 |
| F | 300 | >4,000 |
| G | 3,000 | 220 |
| H | >4,000 | 1,080 |
| I | 3,600 | 1,040 |

A comparison of composition D with composition E demonstrates the very clear viscosity advantage obtained by including the mono-long chain amine or amine-derived components described herein. Further, comparison between composition D and compositions F, G, H and I indicates the benefits obtained using the specific amine or amine-derived components described herein as opposed to other viscosity control agents taught, in the prior art, to be useful in textile treatment compositions.

EXAMPLE III

Compositions of the present invention, having components s given in the table, below, were formulated in the same manner as composition A in Example I. The viscosities of these compositions were measured as described in Example I; the data are summarized in the following table.

| COMPONENTS | WEIGHT % COMPOSITIONS J | K | L |
|---|---|---|---|
| $C_{18}$–$C_{20}$ paraffin | 8 | 8 | 8 |
| Ditallow dimethylammonium chloride | 13 | 13 | — |
| Distearyl dimethylammonium chloride | — | — | 13 |
| Laurylamidopropyl dimethylamine | 0.7 | — | — |

-continued

| COMPONENTS | WEIGHT % COMPOSITIONS J | K | L |
|---|---|---|---|
| SPAED | — | 0.5 | 0.5 |
| Phosphoric acid (85%) | 0.23 | 0.167 | 0.167 |
| Calcium Chloride (ppm) | 650 | 650 | 650 |
| Water and Minors | | BALANCE | |
| Viscosity - 65° C. (centipoise) | 200 | 200 | 65 |
| Viscosity - 65° C./perfumed | 205 | 220 | 75 |
| Viscosity - 25° C. | 140 | 160 | 80 |

These data indicate that the compositions exhibit excellent viscosity, both hot and cold, permitting their easy formulation, processing and manufacture. In addition, the compositions do not form separate phases when stored for long periods of time, and they provide outstanding fabric softening and static control when used in the rinse cycle of a fabric laundering process.

EXAMPLE IV

The compositions given in the table, below, are formulated in the same manner as composition A in Example I. These compositions exhibit excellent phase stability and viscosity properties and give outstanding fabric softening and static control performance when used in the rinse cycle of an automatic laundering operation.

| COMPONENTS | WEIGHT % COMPOSITIONS M | N | O | P | Q | R | S | T | U |
|---|---|---|---|---|---|---|---|---|---|
| $C_{14}$–$C_{17}$ paraffin | 8 | — | — | 12 | 18 | 10 | 18 | — | 12 |
| $C_{18}$–$C_{20}$ paraffin | — | 8 | — | — | — | — | — | 6 | — |
| $C_{20}$–$C_{22}$ paraffin | — | — | 10 | — | — | — | — | — | — |
| Ditallow dimethylammonium chloride | 13 | 11 | 10 | — | — | — | — | 13 | — |
| 1-methyl-1-(tallowylamido) ethyl-2-tallowyl-4,5 dihydroimidazolinium methyl sulfate | — | — | — | 12 | 10 | 15 | 12 | — | 13 |
| SPAED | — | 1 | — | 0.5 | — | 0.5 | 2 | 0.5 | 0.2 |
| Laurylamidopropyl dimethylamine | 0.7 | — | 1 | — | 0.5 | — | — | — | — |
| Phosphoric Acid (85% active) | 0.23 | 0.33 | 0.45 | 0.167 | 0.25 | 0.167 | 0.62 | 0.17 | 0.07 |
| Calcium chloride (ppm) | 650 | 550 | 600 | 500 | 550 | 600 | 500 | 500 | 350 |
| Water and Minors (includes dye and perfume) | | | | | BALANCE TO 100 | | | | |

I claim:

1. An aqueous textile treatment composition exhibiting viscosities of no more than about 700 centipoise over the temperature range of 25° C. to 65° C., said composition comprising (a) from about 8% to about 16% of water-insoluble cationic fabric softener selected from the group consisting of (i) compounds of the general formula $R^aR^bR^cR^dN^+X^-$ wherein $R^a$ and $R^b$ are each selected from $C_{12}$–$C_{24}$ alkyl groups, $R^c$ and $R^d$ are each selected from $C_1$–$C_4$ alkyl groups and X is an anion, (ii) Di-$C_{12}$–$C_{24}$ alkyl imidazolinium salts, and (iii) mixtures thereof;

(b) from about 5% to about 20% of $C_{14}$–$C_{22}$ hydrocarbon;

(c) from about 0.15% to about 0.7% of an amine-derived compound having the formula

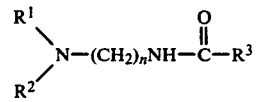

wherein $R^1$ and $R^2$ are each selected from methyl or ethyl groups, n is 2 or 3, and $R^3$ is a $C_{16}$–$C_{18}$ alkyl group; wherein the weight ratio of (a):(b) is from about 3:1 to 1:2.

2. A composition as recited in claim 1, wherein the cationic fabric softener is ditallowyl imidazolinium salt, wherein the hydrocarbon is $C_{14}$–$C_{17}$ paraffin, and wherein the amine-derived compound is present at a level of from about 0.15% to about 0.6% and is $C_{16}$–$C_{18}$ amido ethyl diethylamine.

3. A composition as recited in claim 2, comprising 12% ditallowyl imidazolinium salt, 18% $C_{14}$–$C_{17}$ paraffin, 0.5% $C_{16}$–$C_{18}$ amido ethyl diethylamine, 0.167% phosphoric acid (85% active) and 500 ppm calcium chloride.

4. A composition as recited in claim 1, wherein the cationic fabric softener is di-$C_{16}$–$C_{22}$ dimethylammonium salt and the hydrocarbon is $C_{18}$–$C_{20}$ paraffin.

5. A composition as recited in claim 4, wherein the cationic fabric softener is selected from the group consisting of ditallow dimethylammonium chloride and distearyl dimethylammonium chloride and wherein the amine-derived compound is $C_{16}$–$C_{18}$ amido ethyl diethylamine.

6. A composition as recited in claim 5, comprising 8% $C_{18}$–$C_{20}$ paraffin, 13% of said cationic fabric softener, 0.5% of said amine-derived compound, 0.167% phosphoric acid (85% active) and 650 ppm calcium chloride.

* * * * *